US007604108B2

(12) United States Patent
González Alemany et al.

(10) Patent No.: US 7,604,108 B2
(45) Date of Patent: Oct. 20, 2009

(54) PALLET ASSEMBLY FOR A TRANSPORT SYSTEM FOR THE MOVEMENT OF PASSENGERS/GOODS

(75) Inventors: Miguel Angel González Alemany, Oviedo (ES); Juan Domingo Gonzalez Pantiga, Gijón (ES); Manuel Alonso Cuello, Gijón (ES); Abdón Muniz Camblor, Oviedo (ES)

(73) Assignees: Thyssenkrupp Norte, S.A., Asturias (ES); Thyssenkrupp Elevators (ES/PBB) Ltd., London (GB)

( * ) Notice: Subject to any disclaimer, the term of this patent is extended or adjusted under 35 U.S.C. 154(b) by 104 days.

(21) Appl. No.: 11/965,361

(22) Filed: Dec. 27, 2007

(65) Prior Publication Data

US 2008/0164120 A1 Jul. 10, 2008

(30) Foreign Application Priority Data

Dec. 29, 2006 (ES) ..... 200603322

(51) Int. Cl.
*B66B 23/02* (2006.01)

(52) U.S. Cl. ..... 198/330; 198/325; 198/327

(58) Field of Classification Search ..... 198/321, 198/325, 326, 327, 330, 334
See application file for complete search history.

(56) References Cited

U.S. PATENT DOCUMENTS

| | | | | |
|---|---|---|---|---|
| 4,082,173 | A * | 4/1978 | Simon-Kochloffel | 198/330 |
| 5,595,278 | A * | 1/1997 | Ostermeier et al. | 198/333 |
| 5,697,487 | A * | 12/1997 | Engelke et al. | 198/333 |
| 6,675,949 | B1 | 1/2004 | Gonzalez Alemany et al. | |
| 6,832,678 | B2 * | 12/2004 | Ogura et al. | 198/322 |
| 7,063,202 | B2 * | 6/2006 | Ossendorf | 198/321 |

FOREIGN PATENT DOCUMENTS

| | | |
|---|---|---|
| ES | 2 179 720 | 1/2003 |

* cited by examiner

*Primary Examiner*—James R Bidwell
(74) *Attorney, Agent, or Firm*—Merchant & Gould P.C.

(57) ABSTRACT

The invention relates to a pallet assembly (100, 101) for a transport system for the movement of passengers/goods formed by a moving endless belt based on said pallet assemblies (100, 101). Each assembly has: a driven pallet (101) which is driven by a drive pallet (100), both pallets (100, 101) being hinged to one another according to an axis perpendicular to a movement direction D of the belt. The pallets (100, 101) have a rocking beam (13) having: an end hinged to a functional surface according to an axis perpendicular to the movement direction D; another end having: at least one concave arc (130) perpendicular to the longitudinal movement direction D in the form of a claw; to form a meshing: in a direction perpendicular to the longitudinal movement direction D; between drive equipment (300, 300') and the drive pallet (100) through the concave arc (130).

12 Claims, 3 Drawing Sheets

PALLET ASSEMBLY FOR A TRANSPORT SYSTEM FOR THE MOVEMENT OF PASSENGERS/GOODS

FIELD OF THE INVENTION

The invention relates to a pallet assembly for a transport system for the movement of passengers/goods and more specifically to pallets for systems having low speed sections located in an embarking/disembarking area, a high speed section located in a middle area and transitional speed sections located between the embarking/disembarking area and the middle area.

The invention is applied to mechanical walkways such as those used in airports, stations and generally in large public places in which users must walk more or less large sections and in which it is intended to make this type of movement easier.

BACKGROUND OF THE INVENTION

It is common to find mechanical walkways like those mentioned above in which various sections are established, acting at different speeds such that, according to the operating direction thereof, a first embarking area having a slow speed, an acceleration area, a maximum speed intermediate area, a deceleration area, and a slow speed disembarking area are established in the walkway.

To achieve the variable speed which is necessary in the acceleration and deceleration areas, there are different solutions including the one provided in ES2179720. Said document describes an acceleration walkway with a moving surface formed by plate assemblies, each one formed by a front plate and a rear plate, hinged to one another according to an axis perpendicular to the operating direction. The rear plate of each assembly is assembled on lateral guides and chains, whereas front plate is connected to the rear plate of the plate assembly located immediately in front of it. The chains are formed by bent and straight links and are driven between lateral guides causing the tilting of the links. The walkway includes embarking and disembarking areas in which the plates circulate at slow speed, a central area in which the plates circulate at fast speed, and two transition areas in which the plates accelerate and decelerate as a result of the folding or unfolding of the lateral chains.

SUMMARY OF THE INVENTION

The present invention proposes a pallet assembly for a transport system in which the drive elements of the pallets have a more simplified operation than in the state of the art closest to the invention. Instead of using a single drive element with high mechanical complexity to provide sections with different speed profiles, namely low speed in embarking and disembarking areas, high speed in the central area and the corresponding transition areas between the high and low speed areas, a radically different design is chosen.

In the transport system incorporating the pallet assembly of the present invention different drive means are used for each of the areas with a different speed profile, choosing the simplest possible design for each one of these areas meeting the system requirements; thus, a chain for the embarking-low speed area, a chain for the disembarking-low speed area, a chain for the central-maximum speed area, a variable pitch screw for the acceleration area from the embarking-low speed area to the central-maximum speed area and a variable pitch screw for the deceleration area from the central-maximum speed area to the disembarking-low speed area, are arranged. The pallet assembly of the present invention thus comprises meshing means selectively meshing with the corresponding drive means in each area. The meshing means are formed by a rocking beam having a first end connected to a functional face of the pallets and a second end provided with the meshing means for meshing with the drive means. The second end comprises claw-shaped arcs to mesh with the low and high speed drive chains, and a roller to mesh with the variable pitch screws of the acceleration and deceleration areas.

This arrangement allows greater modularity because any of the system components can be more flexibly chosen and replaced given that each speed area of the system is approached as a subassembly.

Another advantage of the transport system incorporating the pallet assembly of the present invention is that since the components are more conventional than in the closest state of the art, their manufacture is much less complicated; therefore, both the initial system cost and the cost of replacing any of its components is substantially less.

Another result of this greater mechanical simplicity is the duration of the system components: they experience less deterioration, which results in a longer useful life of said components, and this translates into a longer system operating time between maintenance stop periods, and into greater reliability.

The invention relates to a pallet assembly for a transport system for the movement of passengers/goods formed by a moving endless belt based on said pallet assemblies, in which each assembly:

- has a support surface configured to support a passenger/good and has variable length;
- comprises a driven pallet which is driven by a drive pallet, both pallets being hinged to one another according to an axis perpendicular to a movement direction D of the belt;

characterized in that:

- the pallets comprise:
  - a functional surface opposite to the support surface and having first meshing means;
- the first meshing means comprise a rocking beam having:
  - a first end hinged to the functional surface according to an axis perpendicular to the movement direction D;
  - a second end opposite to the first end having:
    - at least one concave arc perpendicular to the longitudinal movement direction D in the form of a claw;

to form a first/second meshing:

- in a direction perpendicular to the longitudinal movement direction D;
- between first drive means/second drive means and the drive pallet through the concave arc.

The second end can comprise two concave arcs, a first arc to mesh with first drive means and a second arc to mesh with second drive means.

In the pallet assembly of the invention:

- the first meshing means can comprise a rocking beam having:
  - a first end hinged to the functional surface according to an axis perpendicular to the movement direction D;
  - a second end opposite to the first end having:
    - a drive roller perpendicular to the longitudinal movement direction D;

to form a third meshing:

- in a direction perpendicular to the longitudinal movement direction D;

between third drive means and the drive pallet through the drive roller.

The rocking beam can have at least one wheel at the second end configured to roll on a guide running along the belt and acting as a cam to drive a tilting of the rocking beam between first/second meshing and third meshing positions.

The rocking beam can have two arms between the second ends of which the drive roller is located.

When the rocking beam has two arms, it can incorporate a wheel on each of its outer sides. These wheels are configured to roll between the guides running along the belt and acting as cams to cause the tilting of the rocking beam, along the forward movement section of the belt, between a lower position, along the faster speed movement section of the belt, in which the downward lateral claws lock with the chains, and a high position, along the speed variation and lower speed movement sections of the belt, in which said claws are separated from the chains if the transversal roller meshes with one of the variable pitch screws.

In one configuration of the invention, the arms can be parallel.

In addition, in the pallet assembly of the invention:

the drive pallet can comprise two first lower pulley wheels on each side;

the driven pallet can comprise a second lower pulley wheel on each side;

the pulley wheels of each side of both pallets can be located on planes at different distances from a surface of the pallet; and they can be configured to move through rails parallel to the movement direction D running along the path of the belt.

The pulley wheels of each side of both pallets can be located on planes at different distances from the edge adjacent to the pallet.

The second pulley wheels can be located closer to the driven pallet than the first pulley wheels of the drive pallet.

pulley wheels of both sides can be arranged in symmetrical positions in relation to a longitudinal middle plane of the belt.

In the pallet assembly of the invention:

the drive pallet can comprise a plurality of first combs;

the driven pallet can comprise a plurality of second combs configured to be coupled with the first combs and guide a movement between the drive pallet and the driven pallet.

addition, a pallet selected from the drive pallet, the driven pallet and combinations thereof, can comprises inserts to indicate to a user a demarcation between the pallets.

BRIEF DESCRIPTION OF THE DRAWINGS

A series of drawings will be very briefly described below aiding to better understand the invention and which are specifically related to an embodiment of said invention, presented as a non-limiting example thereof.

DETAILED DESCRIPTION OF THE PREFERRED EMBODIMENT(S)

Figure 1:
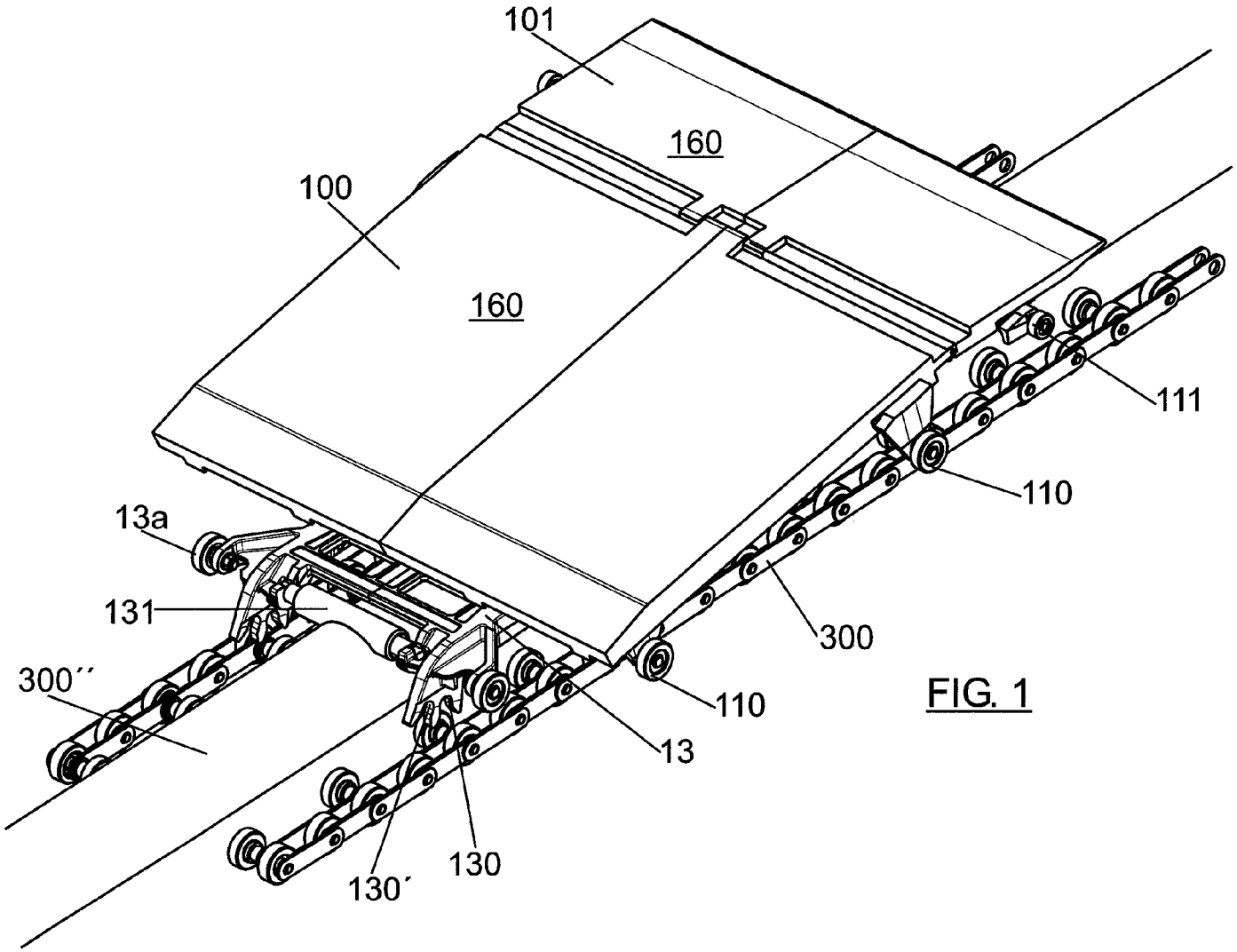
FIG. 1 is a perspective view showing the assembly of the invention meshed with third drive means.
Figure 2:
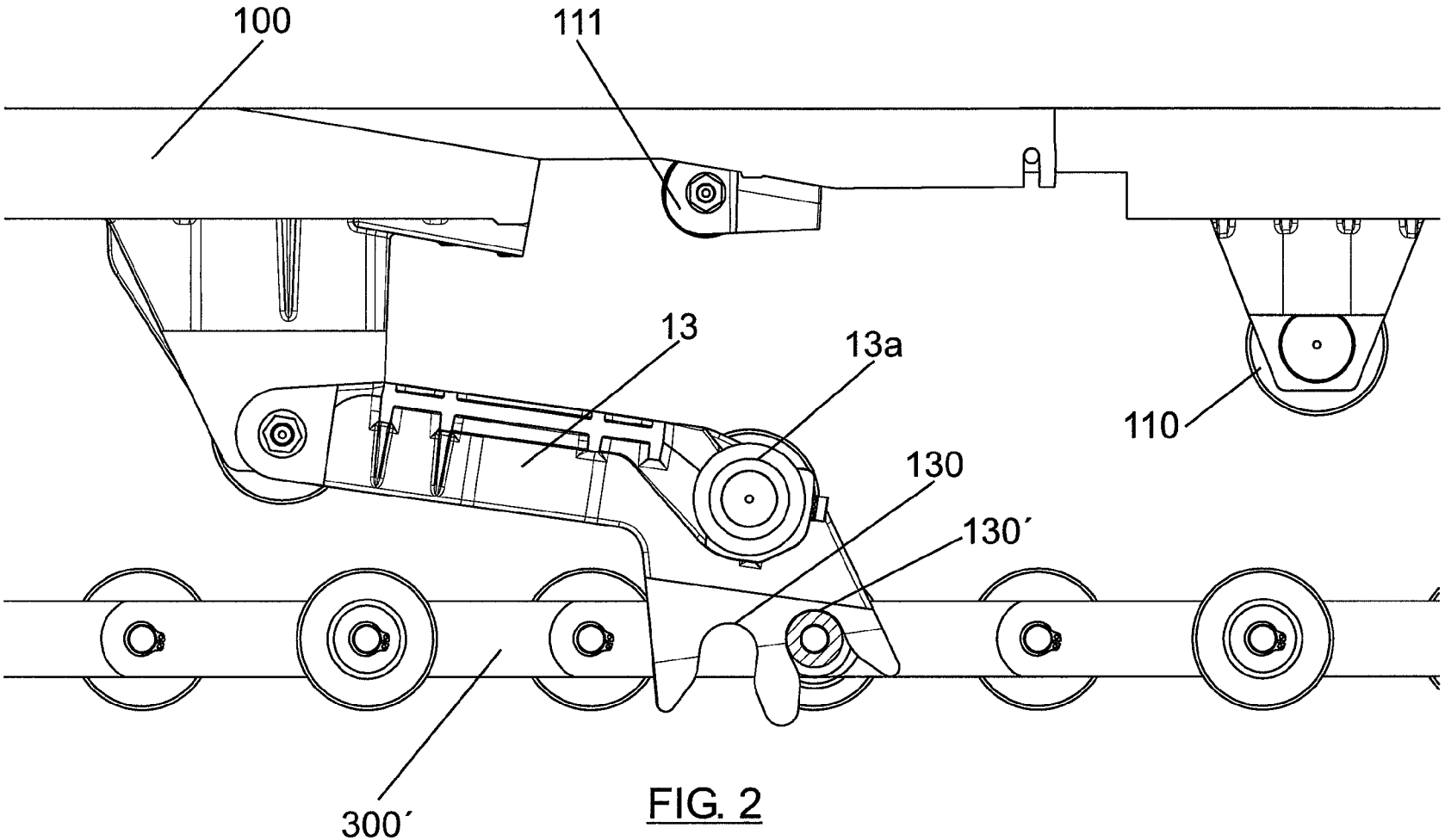
FIG. 2 is a detail showing the rocking beam of the assembly of the invention, in which a first concave arc is meshed with first drive means.
Figure 3:
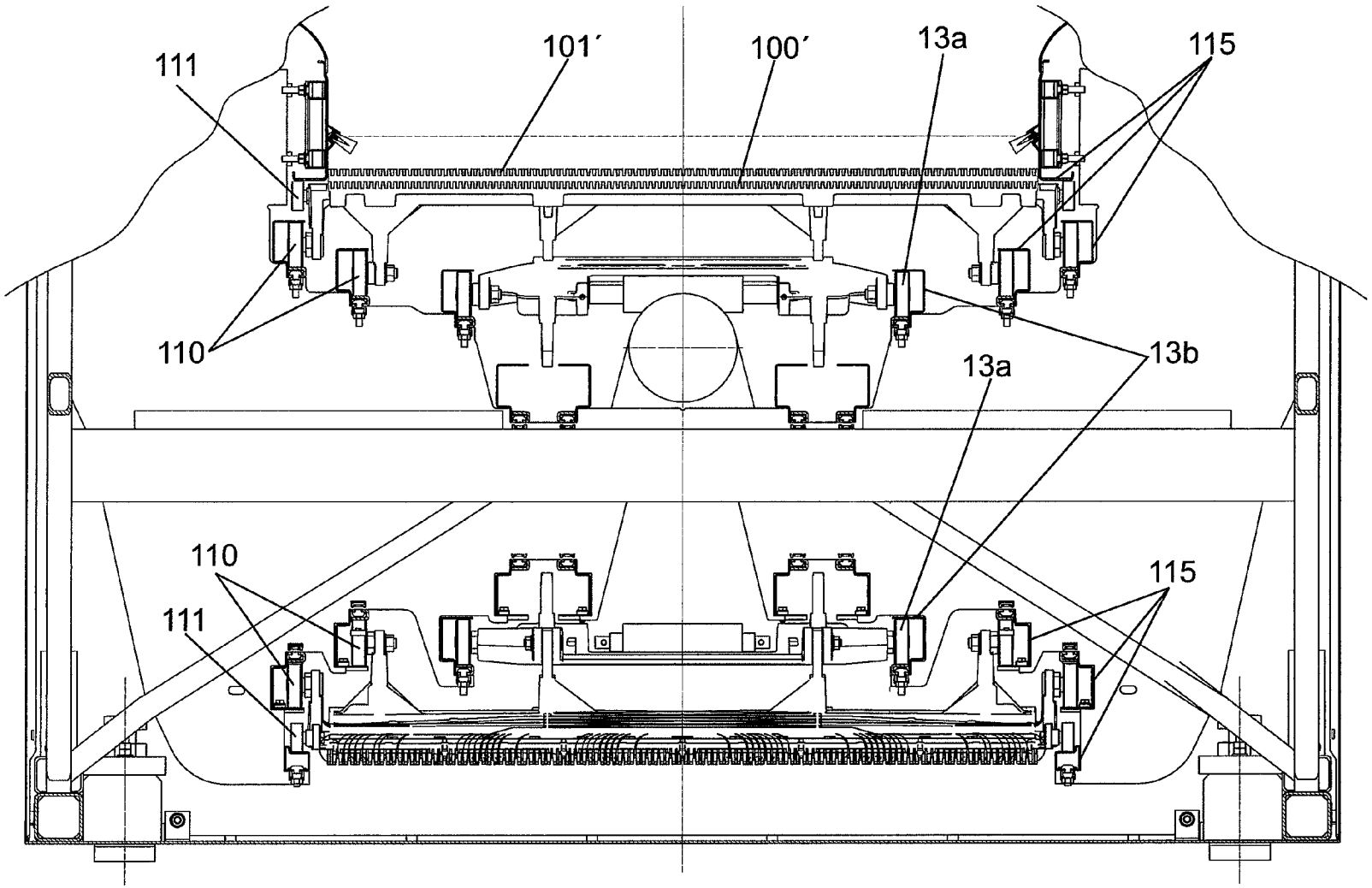
FIG. 3 is a cross-section of a transport system including the pallet assembly of the invention.

One embodiment of the invention relates to a pallet assembly (100, 101) for transport system for the movement of passengers/goods formed by a moving endless belt based on said pallet assemblies (100, 101), in which each assembly:

has a support surface (160) configured to support a passenger/good and having variable length;

comprises a driven pallet (101) which is driven by a drive pallet (100), both pallets (100, 101) being hinged to one another according to an axis perpendicular to a movement direction D of the belt;

characterized in that:

the pallets (100, 101) comprise:

a functional surface opposite to the support surface (160) and having first meshing means (130, 131);

the first meshing means (130, 131) comprise a rocking beam (13) having:

a first end hinged to the functional surface according to an axis perpendicular to the movement direction D;

a second end opposite to the first end having:

at least one concave arc (130) perpendicular to the longitudinal movement direction D in the form of a claw;

to form a first/second meshing:

in a direction perpendicular to the longitudinal movement direction D;

between first drive means (300)/second drive means (300') and the drive pallet (100) through the concave arc (130).

The second end comprises two concave arcs, a first arc (130) to mesh with first drive means (300) and a second arc (130') to mesh with second drive means (300').

In the pallet assembly (100, 101) of the invention:

the first meshing means (130, 131) comprise a rocking beam (13) having:

a first end hinged to the functional surface according to an axis perpendicular to the movement direction D;

a second end opposite to the first end having:

a drive roller (131) perpendicular to the longitudinal movement direction D;

to form a third meshing:

in a direction perpendicular to the longitudinal movement direction D;

between third drive means (300") and the drive pallet (100) through the drive roller (131).

The rocking beam (13) has at least one wheel (13*a*) at the second end configured to roll on a guide (13*b*) running along the belt and acting as a cam to drive a tilting of the rocking beam (13) between first/second meshing and third meshing positions.

The rocking beam (13) has two arms between the second ends of which the drive roller (131) is located.

When the rocking beam (13) has two arms, it can incorporate a wheel on each one of its outer sides. These wheels are configured to roll between the guides running along the belt and acting as cams to cause the tilting of the rocking beam (13), along the forward movement section of the belt, between a lower position, along the faster speed movement section of the belt, in which the downward lateral claws lock with the chains, and a high position, along the speed variation and lower speed movement sections of the belt, in which said claws are separated from the chains if the transversal roller meshes with one of the variable pitch screws.

In one embodiment of the invention, the arms are parallel.

In addition, in the pallet assembly (100, 101) of the invention:

the drive pallet (100) comprises two first lower pulley wheels (110) on each side;

the driven pallet (101) comprises a second lower pulley wheel (111) on each side;

the pulley wheels (110, 111) of each side of both pallets (100, 101)

are located on planes at different distances from a surface of the pallet (100, 101); and are configured to move through rails (115) parallel to the movement direction D running along the path of the belt.

The pulley wheels (110, 111) of each side of both pallets (100, 101) are located on planes at different distances from the edge adjacent to the pallet (100, 101).

The second pulley wheels (111) are located closer to the driven pallet (101) than the first pulley wheels (110) of the drive pallet (100).

The pulley wheels (110, 111) of both sides are arranged in symmetrical positions in relation to a longitudinal middle plane of the belt.

In the pallet assembly (100, 101) of the invention:

the drive pallet (100) comprises a plurality of first combs (100');

the driven pallet (101) comprises a plurality of second combs (101') configured to be coupled with the first combs (100') and guide a movement between the drive pallet (100) and the driven pallet (101).

In addition, a pallet selected from the drive pallet (100), the driven pallet (101) and combinations thereof, comprises inserts to indicate to a user a demarcation between the pallets.

The invention claimed is:

1. A pallet assembly for a transport system for the movement of passengers/goods formed by a moving endless belt based on said pallet assemblies, in which each assembly:

has a support surface configured to support a passenger/good and having variable length;

comprises a driven pallet which is driven by a drive pallet, both pallets being hinged to one another according to an axis perpendicular to a movement direction D of the belt;

wherein:

the pallets comprise:

a functional surface opposite to the support surface and having first meshing means;

the first meshing means comprising a rocking beam having:

a first end hinged to the functional surface according to an axis perpendicular to the movement direction D;

a second end opposite to the first end having:

at least one concave arc perpendicular to the longitudinal movement direction D in the form of a claw;

to form a first/second meshing:

in a direction perpendicular to the longitudinal movement direction D;

between first drive means second drive means and the drive pallet through the concave arc.

2. The pallet assembly of claim 1, wherein the second end comprises two concave arcs, a first arc to mesh with first drive means and a second arc to mesh with second drive means.

3. The pallet assembly of claim 1, wherein:

the first meshing means comprise a rocking beam having:

a first end hinged to the functional surface according to an axis perpendicular to the movement direction D;

a second end opposite to the first end having:

a drive roller perpendicular to the longitudinal movement direction D;

to form a third meshing:

in a direction perpendicular to the longitudinal movement direction D;

between third drive means and the drive pallet through the drive roller.

4. The pallet assembly of claim 1, wherein the rocking beam has at least one wheel on the second end configured to roll on a guide running along the belt and acting as a cam to drive a tilting of the rocking beam between first/second meshing and third meshing positions.

5. The pallet assembly of claim 3, wherein the rocking beam has two arms between the second ends of which the drive roller is located.

6. The pallet assembly of claim 5, wherein the arms are parallel.

7. The pallet assembly of claim 1, wherein:

the drive pallet comprises two first lower pulley wheels on each side;

the driven pallet comprises a second lower pulley wheel on each side;

the pulley wheels of each side of both pallets are located on planes at different distances from a surface of the pallet; and are configured to move through rails parallel to the movement direction D running along the path of the belt.

8. The pallet assembly of claim 7, wherein the pulley wheels of each side of both pallets are located on planes at different distances from the edge adjacent to the pallet.

9. The pallet assembly of claim 7, wherein the second pulley wheels are located closer to the driven pallet than the first pulley wheels of the drive pallet.

10. The pallet assembly of claim 7, wherein the pulley wheels of both sides are arranged in symmetrical positions in relation to a longitudinal middle plane of the belt.

11. The pallet assembly of claim 1, wherein:

the drive pallet comprises a plurality of first combs;

the driven pallet comprises a plurality of second combs configured to be coupled with the first combs and guide a movement between the drive pallet and the driven pallet.

12. The pallet assembly of claim 1, wherein a pallet selected from the drive pallet, the driven pallet and combinations thereof, comprises inserts to indicate to a user a demarcation between the pallets.

* * * * *